United States Patent [19]

Fuller et al.

[11] Patent Number: 4,531,666

[45] Date of Patent: Jul. 30, 1985

[54] METHOD OF MAKING TUBES

[75] Inventors: Oliver C. Fuller; James R. Bennett; J. Hall Skeen, all of Hinsdale, Ill.

[73] Assignee: Oliver C. Fuller, Hinsdale, Ill.

[21] Appl. No.: 526,110

[22] Filed: Aug. 24, 1983

[51] Int. Cl.[3] ..... B23K 31/02

[52] U.S. Cl. ..... 228/171; 72/305; 29/446

[58] Field of Search ..... 29/155 C, 446; 228/170, 228/171; 72/395, 305, 369

[56] References Cited

U.S. PATENT DOCUMENTS

| | | | |
|---|---|---|---|
| 20,559 | 6/1858 | Hobson | 72/305 |
| 57,475 | 8/1866 | Caswell | 72/305 |
| 1,097,909 | 5/1914 | Best | 72/305 |
| 1,449,813 | 3/1923 | Feller et al. | 72/295 |
| 1,594,658 | 8/1926 | Bushong | 29/155 C |
| 1,877,583 | 9/1932 | Pfaff | 29/155 C |
| 2,463,966 | 3/1949 | Hauschild | 72/305 |
| 3,262,301 | 7/1966 | Langworthy | 72/305 |
| 4,156,588 | 5/1979 | Miller et al. | 72/369 |
| 4,236,399 | 12/1980 | Williams et al. | 72/295 |

*Primary Examiner*—Kenneth J. Ramsey
*Assistant Examiner*—M. Jordan
*Attorney, Agent, or Firm*—Harness, Dickey & Pierce

[57] ABSTRACT

A method of forming tapered tube sections from a cylindrical tube section and for forming tapered tubes from cylindrical tubes. A cylindrical tube is severed along a plane that is not parallel to its longitudinal axis, the resulting tube sections are reformed into new radii, the tube sections are then reversed and welded together to form a tapered tube of the desired configuration.

5 Claims, 8 Drawing Figures

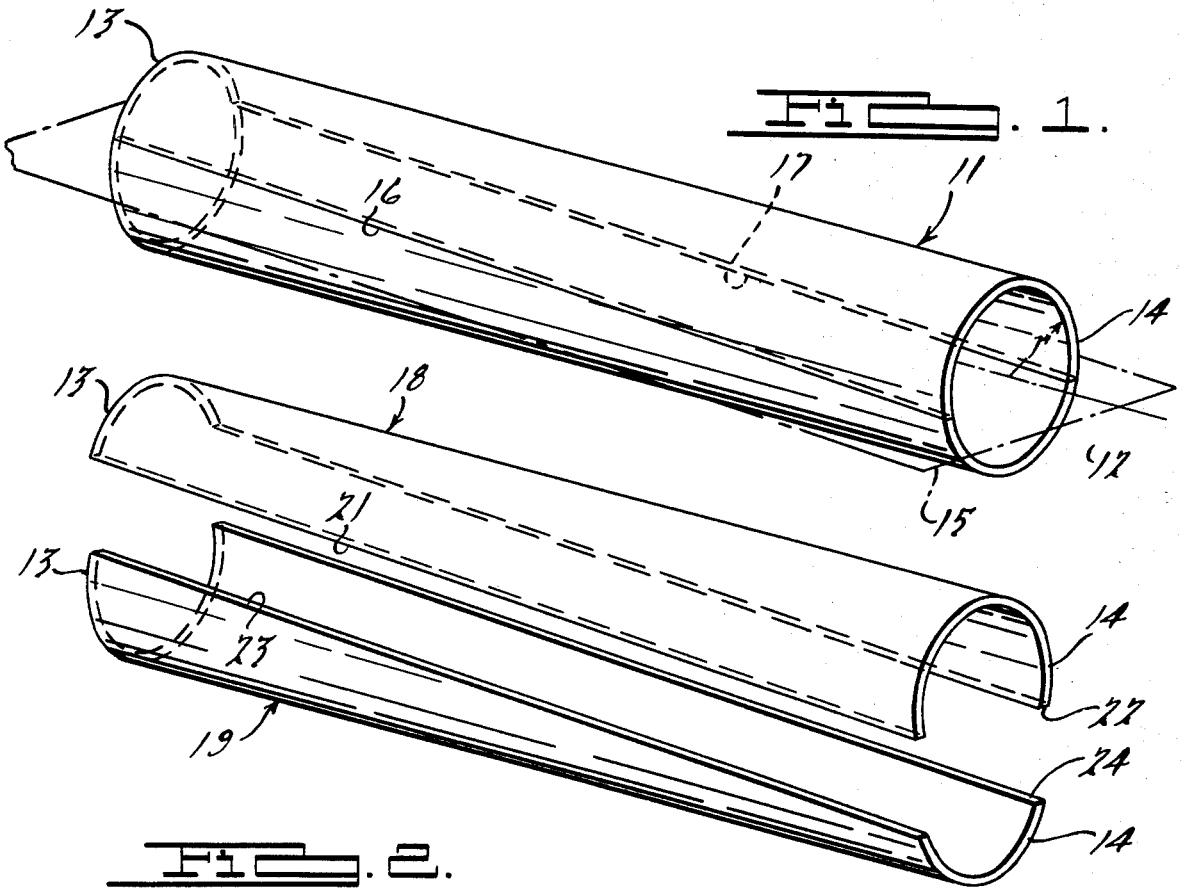
FIG. 1.
FIG. 2.
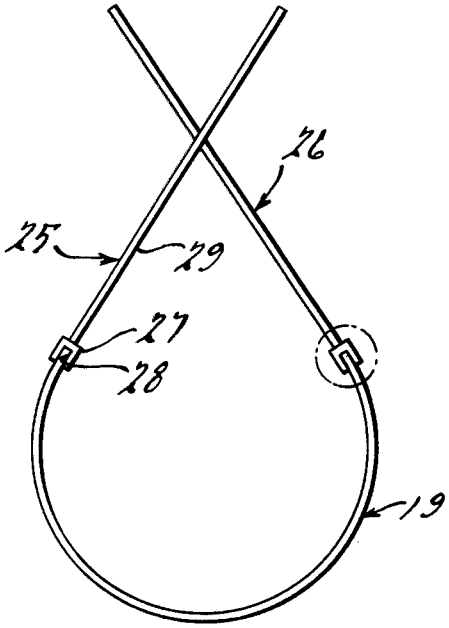
FIG. 3.
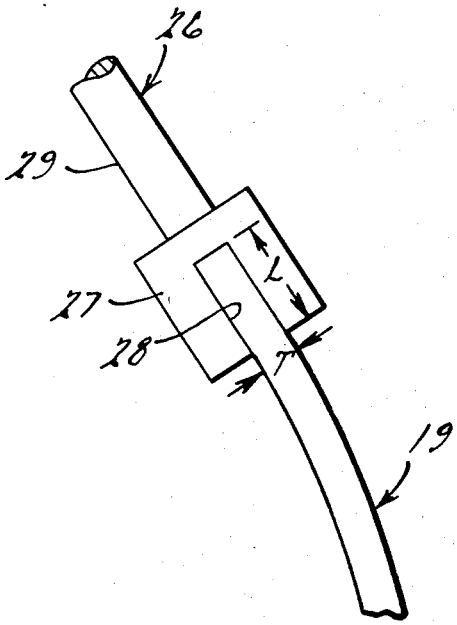
FIG. 4.

FIG. 5.
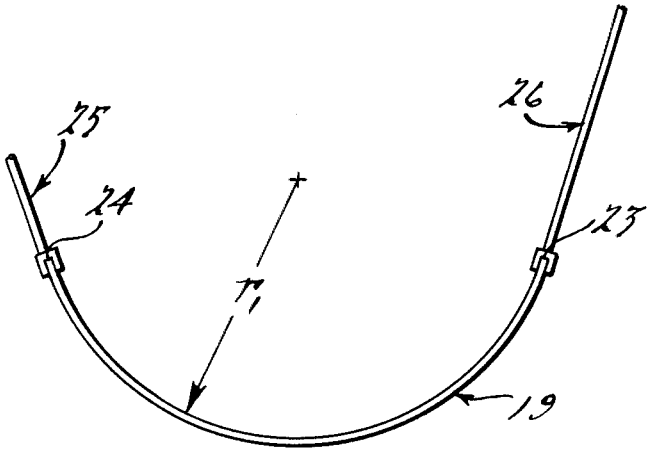
FIG. 6.
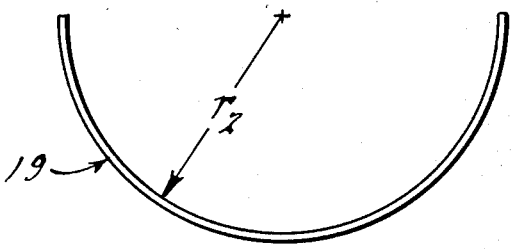
FIG. 7.
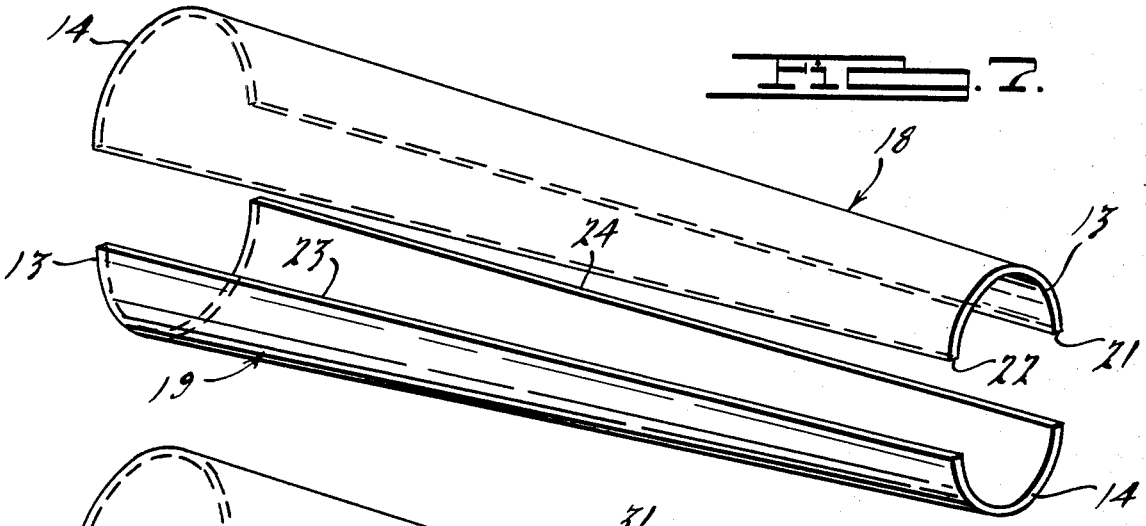
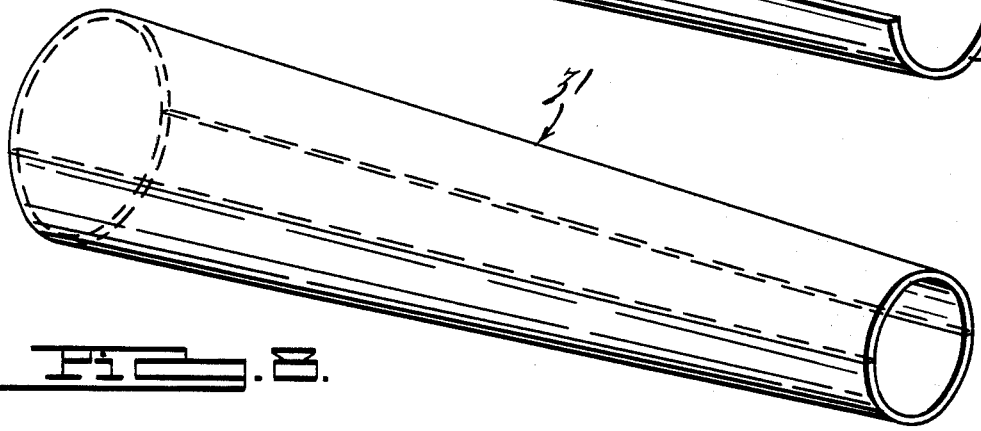
FIG. 8.

METHOD OF MAKING TUBES

CROSS-REFERENCE TO RELATED APPLICATION

This invention is related to the invention of Oliver C. Fuller, entitled "Method Of Forming Tapered Tubes" as disclosed in Application Ser. No. 481,679, filed Apr. 4, 1983 and assigned to the assignee of this application.

BACKGROUND OF THE INVENTION

This invention relates to a method of making tapered tubes and more particularly to an improved method for making tapered tubes for uses such as utility poles.

As noted in the aforementioned application of Oliver C. Fuller, Ser. No. 481,679, the fabrication of hollow tapered tubes has provided several problems. The previously proposed methods have involved forming the tubes from sections made up from flat sheets which must, then, be curved into an arcuate shape. In addition to requiring additional metal forming steps, these methods of the prior art have resulted in some material wastage. As a result, tubes made from the prior art fabrication techniques have been relatively expensive thus limiting their application.

In accordance with the method disclosed in the earlier noted application, a tapered tube is formed from a cylindrical tube. The cylindrical tube is severed along a plane that is not parallel to the longitudinal axis of the tube and the resulting halves are then reversed one relative to the other for reassembly. The reassembled tube is deformed so that cross-sections will be circular in shape with circumferences that are equal to the lengths of the sums of the sides of the respective, reversed halves. As a result, the radius at the big end of the tube will be larger than the radius of the cylindrical tube from which the pole has been formed. The radius at the opposite end will depend upon the angle at which the cylindrical tube has been cut. Such an arrangement and method results in no wastage of material and elminates major forming steps that were required with the prior art methods to form the tubes out of flat stock. It is, however, necessary to reform the halves into a different radius from that of which the cylindrical tube had.

It is, therefore, a principal object of this invention to provide an improved and simplified method for manufacturing tapered tubes.

It is another object of this invention to provide an improved simplified method of forming tapered tubes from cylindrical tubes and for reforming the tapered sections into the desired radius.

It is yet a further object of this invention to provide an improved method for reforming a cylindrical segment into a segment having a tapered configuration of varying radius from one end to the other.

SUMMARY OF THE INVENTION

A first feature of this invention is adapted to be embodied in a method for forming tapered tubes from a cylindrical tube having a first end and a second end spaced along a longitudinal axis. The method comprises the steps of severing the cylindrical tube on opposite sides along a plane that is not parallel or perpendicular to the longitudinal axis to form two parts. In a plane containing the first end, the length of the resulting parts is unequal. Each of the parts is then reformed in planes perpendicular to the longitudinal axis and at distances spaced from the one end into the shape of circular sections each having the radius of a circle having a circumference equal to the length of the first part in the plane plus the length of the second part in a plane parallel to the plane and at the same distance from the second end. The parts are then reversed relative to each other and are joined along their edges to form a tapered tube.

Another feature of the invention is adapted to be embodied in a method of reforming a section of a cylindrical tube into a section of a tapered tube. This method comprises the steps of deforming the cylindrical tube section by applying forces to its longitudinal edges for changing the radius beyond the desired radius an amount sufficient to permit the section to return to the desired radius when the applied forces are removed, and removing the forces to permit the deformed tube to spring back into the desired tapered configuration.

BRIEF DESCRIPTION OF THE DRAWINGS

FIG. 1 is a perspective view of a cylindrical tube severed to form a tapered tube in accordance with the invention.

FIG. 2 is a perspective view, in part similar to FIG. 1, showing the tube parts being separated.

FIG. 3 is an end elevational view showing the method of reforming the severed tube parts.

FIG. 4 is an enlarged view of the encircled area of FIG. 3.

FIG. 5 is an end elevational view, in part similar to FIG. 3, showing the final portion of the reforming step before the tube part is permitted to spring back.

FIG. 6 is an end elevational view showing the reformed tube part.

FIG. 7 illustrates the tube parts oriented for rejoining.

FIG. 8 is a perspective view showing the completed, tapered tube.

DETAILED DESCRIPTION OF THE PREFERRED EMBODIMENTS

Referring now to the drawings, the invention relates to a method for making a tapered tube from a cylindrical tube, such as the tube indicated generally by the reference numeral 11 in FIG. 1. The tube 11 is a right circular element having a longitudinal axis, indicated by the line 12, about which the tubular wall is curved at a radius r. The tube 11 has a first end 13 and a second end 14 with each of the ends being generally perpendicular to the longitudinal axis 12. The tube 11 may be formed of any suitable material such as steel, with the choice of the material being determined by the intended use of the completed tapered tube.

In accordance with the invention, the tube 11 is first severed by making cuts on opposite sides of the axis 12 which cuts lie generally in a plane 15 which plane 15 is not parallel to and not perpendicular to the longitudinal axis 12. The resulting cuts or severs are indicated by the lines 16 and 17 which lie in the plane 15. The inclination of the plane 15 and, accordingly, the cuts 16 and 17 relative to the longitudinal axis 12 will determine the taper of the resulting product, as will become apparent.

Severing of the tube 11 will form two parts, each of which is a segment of a cylinder, these parts being identified by the reference numerals 18 and 19 in FIG. 1. The part 18 has edges 21 and 22 that are formed by the severed lines 16, 17, respectively, and which are determined by the inclination of the plane 15. In a like manner, the tube part 19 has edges 23 and 24 which are parallel to and equally inclined with the edges 21, 22, respectively. If the tube were reassembled by joining the edges 21, 23 and 22, 24, the tube 11 would of course be reformed and would have a cylindrical configuration.

In accordance with the invention, the tube portions 18 and 19 will be reversed relative to each other. Thus, the end 14 of the portion 18 will subsequently be aligned with the end 13 of the portion 19 and vice versa. In order to provide a tapered tube having cylindrical sections, therefore, it will be necessary to reform the individual sections 18 and 19 so as to accommodate this new configuration. Each section will have a radius equivalent to the radius of a circle having a circumference equal to the length of the section 19 in a plane perpendicular to the longitudinal axis 12 and at a distance from the end 13 plus the length of the section 18 in a parallel plane at the same distance from the end 14. Thus, the larger diameter of the tapered tube resulting from a tube severed along the plane 15 will be a radius equivalent to that necessary to provide a circle having the circumference equal to the length 13 of the end of the tube part 19 and the end 14 of the tube part 18. This radius will be larger than the radius r. At the opposite or smaller end, the radius will be equal to the radius necessary to give circumference equal to the length of the end 14 of the tube part 19 and the length of the end 13 of the tube part 18. This radius will be smaller than the radius r assming that the plane 15 intersects the axis 12. An important feature of the invention resides in the method of so reforming the radii of the individual sections.

In accordance with the invention, the tube parts 18 and 19 have their radii reformed by applying a force to their respective edges 21, 22 and 23, 24 in a direction so as to in effect provide a moment at the respective edges. It has been found that by so applying a force to the edges 21, 22 and 23, 24 the parts 18 and 19 are deflected in a manner that a generally circular shape is assumed by each section in planes perpendicular to the longitudinal axis.

Suitable tools for achieving this force application are identified generally by the reference numerals 25 and 26. Each tool 25, 26 is substantially the same in construction and, therefore, the parts of each tool 25, 26 will be identified by the same reference numerals. Each tool includes a gripping or force transmitting part 27 that has a generally channel shape and which defines an opening 28 that is adapted to receive the corresponding tube part edge. The opening 27 is sized, as shown in FIG. 4, so as to have a width T that is approximately equal to one-third of the depth L of the groove. The width T may be approximately equal to the thickness of the wall of the tube 11, of course, allowing such clearance as may be necessary to accommodate manufacturing variations. Affixed to the force applying section 27 is an operating section 29 that is generally elongated. Of course, a number of such tools 25, 26 are received along the respective edges 23, 24 and 21, 22 of the parts 19, 18 during the reforming process.

FIG. 5 shows the condition at the end 13 of the tube part 19. The tools 25 and 26 are moved away from each other to apply moments to the tube portion edges 23 and 24 so as to cause the radius $r_1$ to increase. It has been found, as aforenoted, that this manner of force application causes the part 19 to follow a generally cylindrical section along its length. Of course, the forces applied at the end 14 will be in the opposite direction so as to result in a reduced radius. Sufficient force is applied so as to form a radius $r_1$ that will be affected by permanent deformation of the half 19 which amount of permanent deformation is sufficient so as to accommodate spring back (FIG. 6) to a final radius $r_2$ when the force applied by the tools 25 and 26 is removed. The radius $r_2$ is the radius which will result in a circumference which is equal to the sum as aforenoted.

After the tube parts 18 and 19 have been reformed, they are reversed relative to each other so that the end 14 of the tube part 18 is aligned with the end 13 of the tube part 19 and vice versa (FIG. 7). The aligned edges 23, 23 and 21, 24 are then brought into abutment as shown in FIG. 8 and the edges are affixed together, as by welding. A resulting tapered tube, indicated generally by the reference numeral 31 is thus formed. The tube 31 has a longitudinal axis that is in effect parallel to and the same as the longitudinal axis 12 of the original right circular cylindrical tube 11. However, the diameter at the large end is the diameter which gives a circumference equal to the lengths of the end 13 of the section 19 and the end 14 of the section 18. Hence, this end will have a larger diameter than the end 13 of the tube 11. In a like manner, the diameter at the opposite end may be smaller and is determined by the diameter necessary to provide a circle having a circumference equal to the lengths of the end 14 of the tube part 19 and the end 13 of the tube part 18. Intermediate sections will have corresponding diameter as should be readily apparent.

From the foregoing description, it should be readily apparent that an improved and simplified method has been devised for reforming tube sections and also for forming tapered tubes from uniform diameter cylindrical tubes. A minimum number of forming steps are required and, a very uniform and well shaped tapered tube results. Although an embodiment of the invention has been illustrated and described, it is to be understood that various changes and modifications may be made without departing from the spirit and scope of the invention, as defined by the appended claims.

We claim:

1. The method of forming tapered tubes from a cylindrical tube having a first end and a second end spaced along a longitudinal axis comprising the steps of severing the cylindrical tube on opposite sides and along a plane that is not parallel or perpendicular to the longitudinal axis to form two parts, the lengths of said parts at least the first end being unequal, reforming each of the parts in planes perpendicular to the longitudinal axis into the shape of circular sections at distances from said one end having a radius of a circle having a circumference equal to the length of the first part in the plane plus the length of the second part in a plane parallel to the plane and at the same distance from the second end, reversing one of the halves relative to the other half, and joining the thus reversed halves.

2. The method as set forth in claim 1 wherein the parts are reformed by applying a moment force to the edges thereof.

3. The method as set forth in claim 2 wherein the moment force is applied through a tool having a channel shaped opening receiving the edges of the respective parts and an elongated force applying section.

4. The method as set forth in claim 1 wherein the parts are reformed by applying forces to the edges thereof to permanently deform the parts into a shape having a radius different from the desired finished radius so that when the force is removed the parts will spring back to the desired radius.

5. The method of reforming a section of a cylindrical tube into a section of a tapered tube comprising the steps of deforming the tube section by applying a force to its longitudinal edges for changing the radius beyond the desired radius an amount sufficient to permit the section to return to the desired radius when the deforming force is removed and removing the deforming force.

* * * * *